US006382304B1

(12) United States Patent
Genge

(10) Patent No.: US 6,382,304 B1
(45) Date of Patent: May 7, 2002

(54) METHOD AND DEVICE FOR PRODUCING SLABS IN DIFFERENT SIZES

(75) Inventor: Ulrich Genge, Ratingen (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/508,744

(22) PCT Filed: Sep. 11, 1998

(86) PCT No.: PCT/DE98/02761

§ 371 Date: Mar. 15, 2000

§ 102(e) Date: Mar. 15, 2000

(87) PCT Pub. No.: WO99/14004

PCT Pub. Date: Mar. 25, 1999

(30) Foreign Application Priority Data

Sep. 15, 1997 (DE) ..... 197 41 131

(51) Int. Cl.[7] ..... B22D 11/10; B22D 11/04

(52) U.S. Cl. ..... 164/491; 164/436; 164/418

(58) Field of Search ..... 164/491, 436, 164/459, 418

(56) References Cited

U.S. PATENT DOCUMENTS 5,279,354 A * 1/1994 Grove ..... 164/491
5,520,242 A * 5/1996 Streubel et al. ..... 114/418
5,730,207 A * 3/1998 Pleschiutschnigg ..... 164/459
6,145,580 A * 11/2000 Lamberti et al. ..... 164/418

FOREIGN PATENT DOCUMENTS

JP 61-176446 A * 8/1986

* cited by examiner

*Primary Examiner*—M. Alexandra Elve
*Assistant Examiner*—Len Tran
(74) *Attorney, Agent, or Firm*—Cohen, Pontani, Lieberman & Pavane

(57) ABSTRACT

A process for producing slabs in a continuous casting installation and a continuous casting mold, in particular for the continuous casting of steel slabs, having wide side walls and narrow side walls which delimit the slab mold cavity least one of the wide side walls movable transversely with respect to the mold axis and at least one of the narrow side walls, which can be clamped in between the wide side walls, displaceable transversely with respect to the mold axis in order to change the shape of the strand cross section by an adjustment drive acting in the horizontal direction. Each narrow side is composed of at least two wedge-shaped parts. Mutually facing contact surfaces extend over the entire length (height of the narrow side wall) of each part and the plane of the mutually touching surfaces faces in substantially the same direction as the corresponding wide side inner surfaces (51, 52) assigned to one another with a rotational angle of $\gamma=0$ to 30°. Each case at least one wedge-shaped part is connected to an adjustment device acting in the conveying direction of the strand.

8 Claims, 3 Drawing Sheets

METHOD AND DEVICE FOR PRODUCING SLABS IN DIFFERENT SIZES

BACKGROUND OF THE INVENTION

1. Field of the Invention

The invention relates to a process for producing slabs, in particular from steel, in various formats in a stationary permanent mold, which has wide side walls and narrow side walls, of a continuous casting installation which,. To change the format, the pressure on the appropriate mold side walls is reduced and at least one of the mold walls is displaced into the desired position using appropriate pressure,. The invention further relates to a corresponding device for carrying out the process.

2. Discussion of the Prior Art

German reference DE-A 27 02 976 has disclosed a plate mold for the continuous casting of steel, in which the narrow side walls can be clamped securely between the wide side walls by means of a clamping fixture. In the adjustment range of the narrow side walls of this device, the wide side walls are arranged parallel to one another. Consequently, it is not possible to change the distance between the wide side walls and thus to change the format of the slab with the side walls installed.

Furthermore, European refference EP 0,658,387 A1 has disclosed a permanent mold for the continuous casting of steel strips, the wide side walls of which mold, at the side of a funnel-shaped charging area, are designed with inclined surfaces which move closer to one another toward the outside with respect to the narrow sides.

While in the former case the wide side walls maintain their distance from one another when the narrow side walls move, so that the distance between the rollers in the downstream strand guiding frame does not need to be adjusted, in the latter example the wide side walls move relative to one another in the event of an adjustment of the narrow side walls.

A drawback of the known solutions is that in the first case the slab thickness cannot be increased or reduced and in the second case the adjustment of the slab thickness can only be carried out by simultaneously changing the slab width, i.e. an adjustment of the thickness inevitably entails narrower or wider slabs.

SUMMARY OF THE INVENTION

In recognition of the above-mentioned drawbacks, the object of the invention is to provide a process and a corresponding device for producing slabs not only in any desired width but also in any desired thickness.

According to the invention, to change the format of the slab, the distances between the narrow side walls and consequently the width of the slab and/or the distances between the wide side walls and consequently the thickness of the slab are changed in any desired predeterminable manner. In an advantageous embodiment, the format is set in such a way that between two format changes the load on the strand shell is optimized by keeping the size approximately constant at the appropriate height of the permanent mold.

The continuous casting mold which is required to carry out the process is composed of in each case two wide side walls and two narrow side walls, the narrow side walls being composed of wedge-shaped parts. The narrow side walls comprise at least two wedge-shaped strips, the outer contact surfaces of which bear against the inner wall of the wide sides and the mutually facing contact surfaces of which run over the entire length of the individual parts.

The mutually facing contact surfaces are in this case guided in a plane which is substantially in the same direction as the corresponding wide side surfaces, facing toward one another with an angle of rotation $\gamma$ between 0 and 30°. The angular setting which differs from 0° supports the pressure of the narrow side walls toward the wide side walls.

In an advantageous configuration, a tongue and a groove are provided at this location. The wedge angle $\alpha$ of the side surface parts is preferably selected between 3 and 6°. This angular range has proven sufficient to reliably set the desired thickness of the slab given appropriate vertical adjustment of one part of the narrow sides.

The narrow sides according to the invention which can be set for various slab thicknesses can be used not only with wide sides which are arranged with parallel walls within the narrow side adjustment range, but also with wide sides which are assigned to one another in a wedge shape in the narrow side adjustment range. In an advantageous configuration, a cone angle $\beta$ of from 0.2° to 2.5° is provided here.

However, the adjustable narrow sides according to the invention can be used not only for vertical, stationary permanent molds, but also for molds of a bow-type continuous casting installation. In this embodiment, the wedge-shaped parts follow a constant radius on their mutually facing surfaces, the center of which radius differs from those of the individual wide side radii. During the paired adjustment movement of at least one of the corresponding narrow side parts, they are moved on an arc of a circle which follows the radius of the adjusted wide side.

In a further advantageous configuration, three parts are used per narrow side, in which case the middle wedge is designed symmetrically. In this case, the contact surfaces of the individual side parts may be arranged parallel to the wide side surfaces or conically with respect thereto. If a middle part of double-cone design is used, the side parts are jammed together particularly intimately. Secondly, this ensures that in the event of adjustment to the narrow sides the wide sides are not exposed to any movement whatsoever, or are exposed only to horizontal movement, in the adjustment range.

To achieve a horizontal movement of the narrow sides even without changing their thickness, it is proposed for a coupling to be arranged between the adjustment device and the movable wedge-shaped part.

BRIEF DESCRIPTION OF THE DRAWINGS

One example of the invention is explained in the appended drawing, in which.

DETAILED DESCRIPTION OF THE PREFERRED EMBODIMENTS

Figure 1:
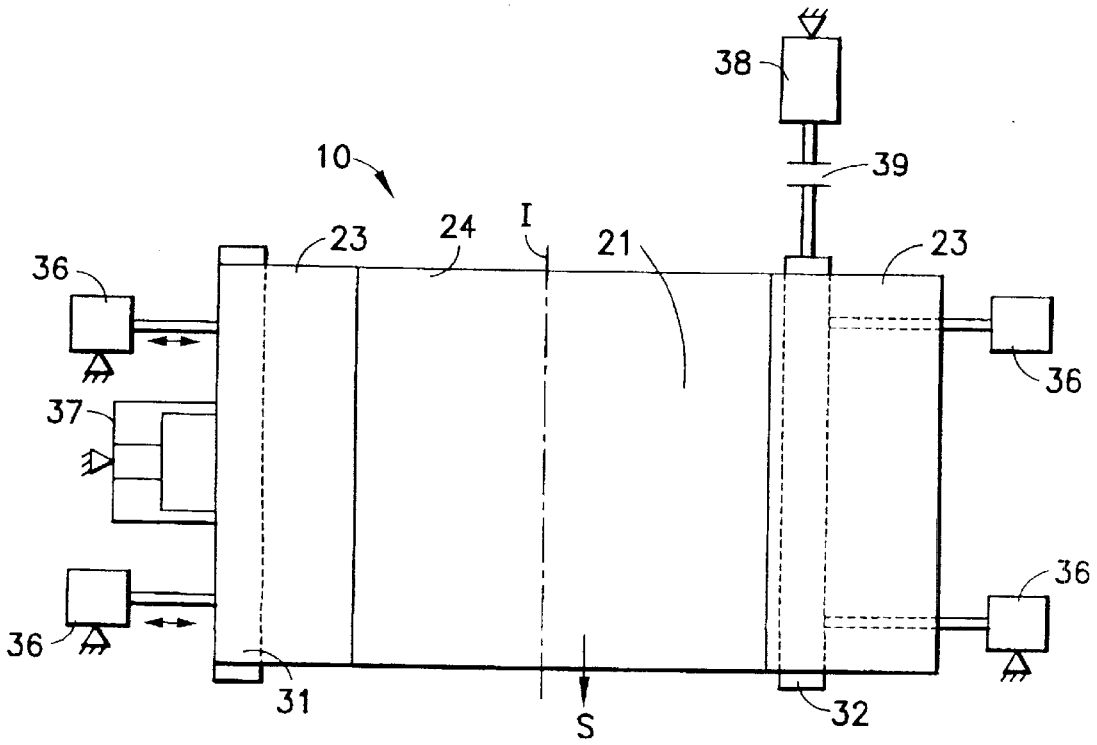
FIG. 1 shows a front view of the inventive mold.

Of a permanent mold 10, FIG. 1 shows a wide side 21 with the charging area 24 and adjustment areas 23 provided at both ends. In these adjustment areas 23, there are narrow sides 31, 32 which by means of horizontal adjusters 36 can be moved transversely with respect to the direction S in which the strand is conveyed and by means of vertical adjusters 37, 38 can be moved parallel to the direction S in which the strand is conveyed. A coupling 39 is arranged between the vertical adjuster 38 and the narrow side 32. In the right-hand part of the figure, the vertical adjuster 38 is arranged in the axial direction of the narrow side 32, while in the left-hand part of the figure the vertical adjuster 37 is provided parallel to the principal axis of the narrow side 31.

Figure 2:
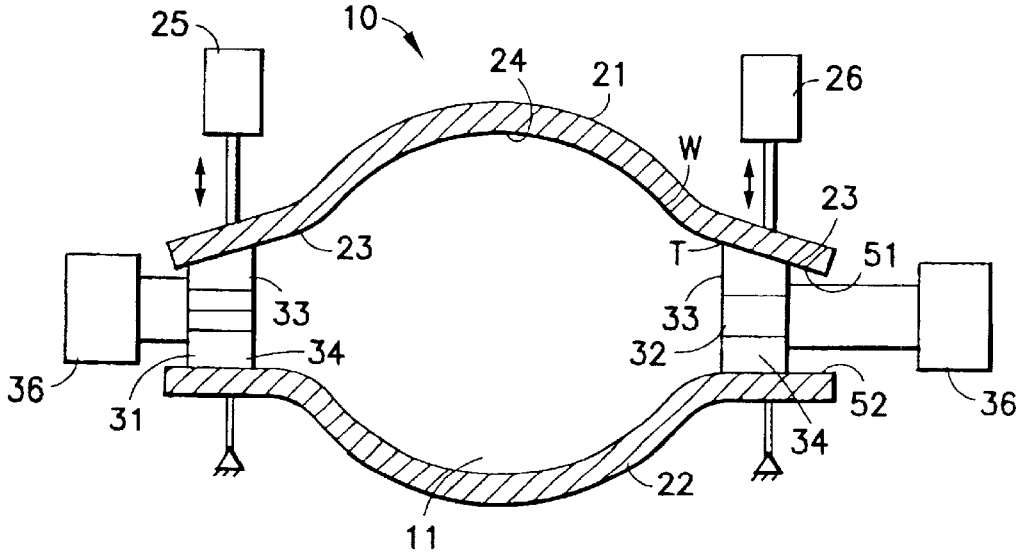
FIG. 2 shows a top view of a straight permanent mold.

FIG. 2 shows a top view of the permanent mold. In the case illustrated, only one wide wall is of movable design, in which case horizontal adjusters 25, 26 are provided on the wide side 21. In this case, the slab mold cavity 11 is enclosed by the wide sides 21 and 22 and the narrow sides 31 and 32. These narrow sides 31, 32 are composed of a first wedge-shaped part 33 and a second wedge-shaped part 34. In the area of the wide side inner surfaces 51 and 52, the individual wedge-shaped parts 33 and 34 can be moved transversely with respect to the direction in which the strand is conveyed by means of horizontal adjusters 36. The adjustment area 23 which is provided with both sides of the charging area 24 is flat-surfaced as seen in the direction S in which the strand is conveyed. In the present illustration, in the left-hand area the transition from the adjustment area to the charging area is relatively abrupt via an edge designed as a radius. In the right-hand part of the figure, the charging area has at its edges a turning point W which merges into an arc of a circle which merges tangentially T into the rectilinear adjustment area 23.

Figure 3A:
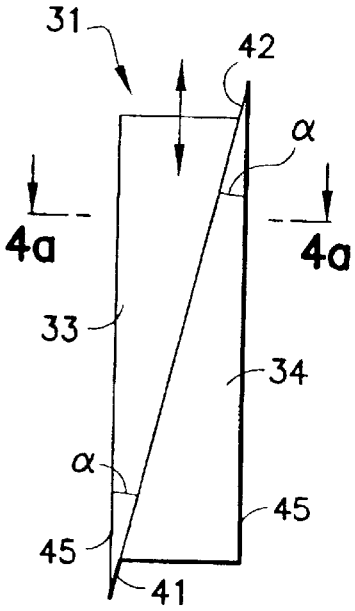
FIGS. 3 and 4 show individual side parts.
Figure 3B:
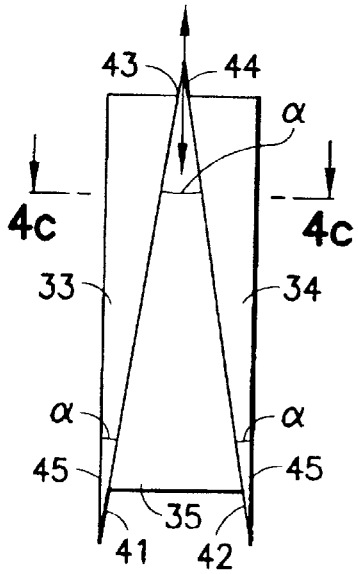
Figure 3C:
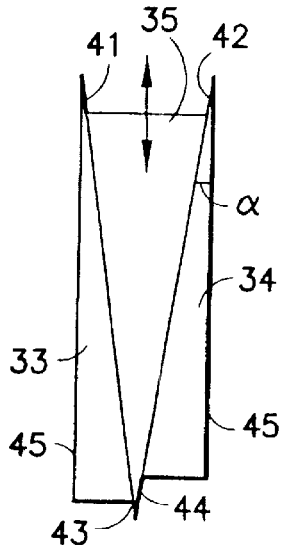
Figure 4A:
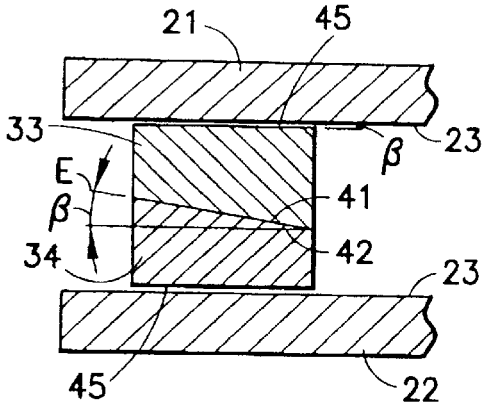
Figure 4B:
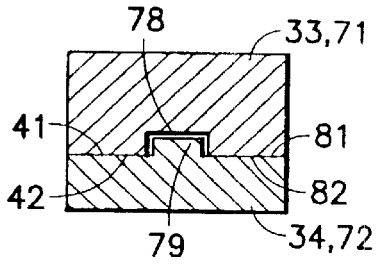
Figure 4C:
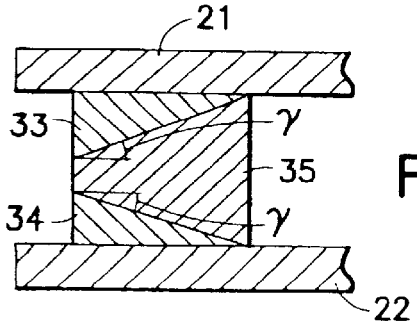

FIG. 3 sketches the structure of the narrow side 31, specifically in side view in the top part of the figure a to c and in section in FIGS. 4*a–c*.

In this case, in FIGS. 3*a* and 4*a* the narrow side 31 is composed of the wedge-shaped parts 33, 34. The contact surfaces 41, 42 are arranged at a wedge angle $\alpha$ with respect to the outer contact surfaces 45.

FIG. 4*a* shows the section AA with the wide side parts 21, 22, between which the wedge-shaped parts 33 and 34 are clamped. The outer contact surfaces 45 bear against the inner wall in the adjustment area 23 of the wide side 21. The facing contact surfaces 41, 42 are located in a plane E which is arranged at an angle of rotation B in respect to a plane located between opposite adjustment surfaces of the wide sides 21 and 22.

The other side views in FIG. 3 show a narrow side 31 which is composed of a total of three wedge-shaped parts 33 to 35. The tip of the middle part 35 may in this case point either upward or downward.

The mutually facing contact surfaces 33 and 44 may be arranged parallel to one another or, as shown in FIG. 4*c* as section BB, may have an angle of rotation $\gamma$ which gives the wedge-shaped part 35 a conical shape in the horizontal direction.

Furthermore, FIG. 4*b* shows an embodiment of the facing contact surfaces 41, 42 of the wedge-shaped parts 33, 34 or 71, 72 in which a groove 78 is provided, into which a tongue 79 projects.

Figure 5:
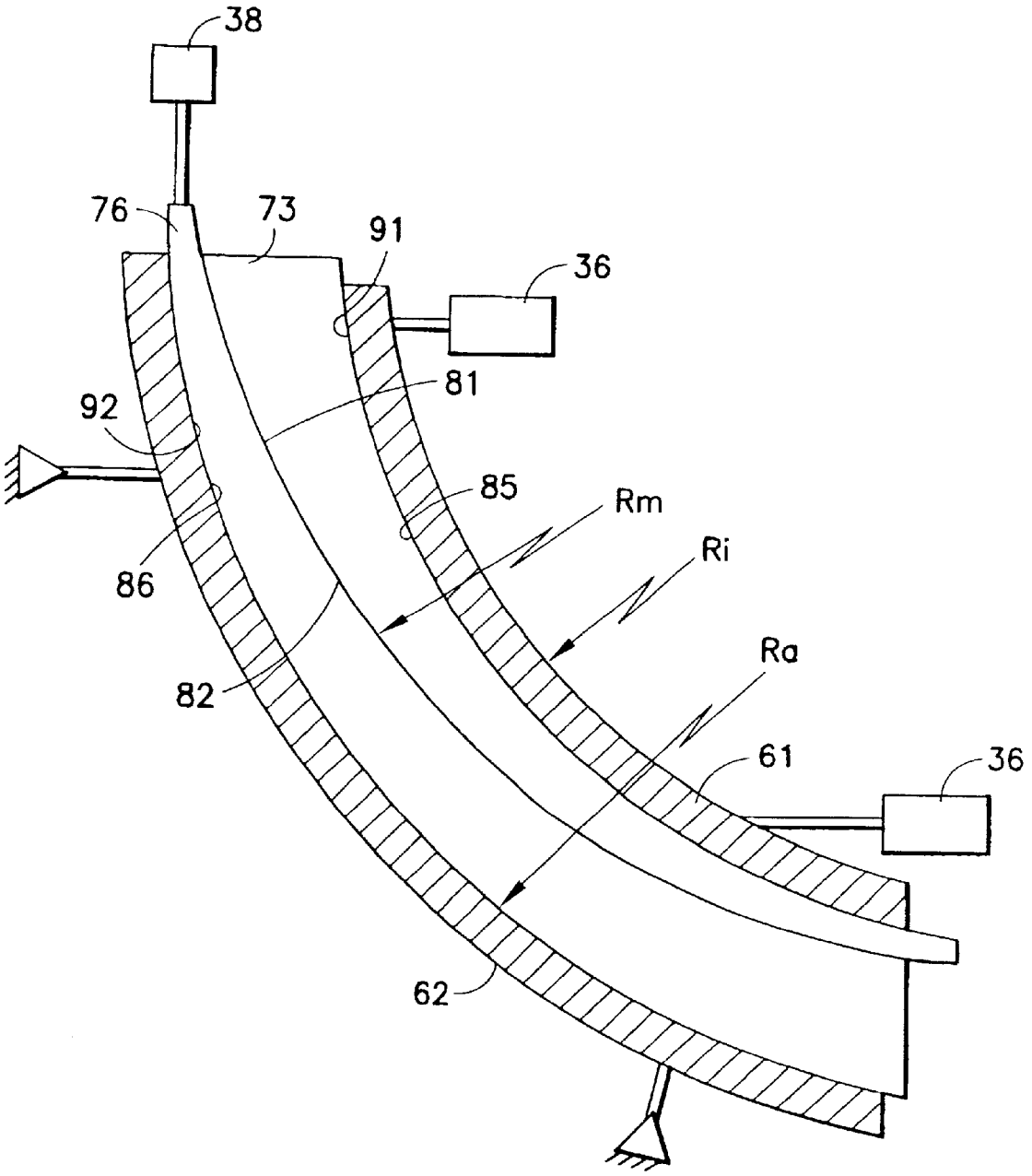
FIG. 5 shows a side view of a mold of a bow-type continuous casting installation.

FIG. 5 shows wide sides 61, 62 of a bow-type continuous casting mold having the radii $R_i$ and $R_a$. The inner wide side 61 can be adjusted by a horizontal adjuster 36.

Narrow side parts 71 and 72 are clamped between the wide sides 61 and 62, the contact surfaces 91, 85 and 92, 86 in each case touching one another.

The facing contact surfaces 81 and 82 have a radius $R_m$. The radii $R_i$ and $R_a$ do not usually have the same center $M_i$ or $M_a$, from which the center of the radius $R_m$, namely $M_m$, is clearly different. The wedge-shaped parts are indicated with 73 and 74.

The invention is not limited by the embodiments described above which are presented as examples only but can be modified in various ways within the scope of protection defined by the appended patent claims.

What is claimed is:

1. A continuous casting mold, comprising: wide side walls and narrow side walls which delimit a slab mold cavity, at least one of the wide side walls being movable transversely with respect to a mold axis; and means for displacing at least one of the narrow side walls, which are clampable between the wide side walls, transversely with respect to the mold axis in order to change strand cross section shape, the displacing means including an adjustment drive acting in a horizontal direction, each narrow side being composed of at least two wedge-shaped parts having mutually facing contact surfaces that extend over an entire length (height of the narrow side wall) of each part, a plane of the mutually facing contact surfaces facing in substantially a common direction with corresponding wide side inner surfaces assigned to one another with an angle of $\gamma$=0 to 30°, at least one of the wedge-shaped parts being connected to an adjustment device acting in the conveying direction of the strand, whereby the narrow sides are adjustable so that the slab width and the slab thickness are independently changeable.

2. A continuous casting mold as defined in claim 1, wherein a wedge angle $\alpha$ of the surfaces of the wedge-shaped side parts lies in a range $\alpha$=3° to 6°.

3. A continuous casting mold as defined in claim 1, wherein the narrow sides are configured to diverge conically away from the slab mold cavity, the narrow sides having outer contact surfaces which correspond to the inner surfaces of the wide sides in the adjustment area.

4. A continuous casting mold as defined in claim 3, wherein the wide sides have a cone angle $\beta$ in the narrow-side adjustment area, where $\beta$=0.2° to 2.5°.

5. A continuous casting mold as defined in claim 1, wherein the wedge-shaped parts have radii which correspond with regard to their contact surfaces bearing against one another, the wedge-shaped parts having outer contact surfaces that are matched to converging inner surfaces of the mold wide sides in the adjustment area.

6. A continuous casting mold as defined in claim 1, wherein the contact inner surface of one of the wedge-shaped parts has a groove and a corresponding inner surface of the other of the wedge-shaped parts has a corresponding tongue.

7. A continuous casting mold as defined in claim 1, wherein each narrow side is composed of a total of three wedge-shaped parts.

8. A continuous casting mold as defined in claim 1, wherein the parts are connected to the adjustment device so that they can move horizontally without being impeded.

* * * * *